US011158495B2

(12) United States Patent
Artaev et al.

(10) Patent No.: US 11,158,495 B2
(45) Date of Patent: Oct. 26, 2021

(54) MULTI-REFLECTING TIME-OF-FLIGHT MASS SPECTROMETER

(71) Applicant: LECO Corporation, St. Joseph, MI (US)

(72) Inventors: Viatcheslav Artaev, St. Joseph, MI (US); Anatoly N. Verenchikov, St. Petersburg (RU)

(73) Assignee: LECO Corporation, St. Joseph, MI (US)

( * ) Notice: Subject to any disclaimer, the term of this patent is extended or adjusted under 35 U.S.C. 154(b) by 0 days.

(21) Appl. No.: 16/494,630

(22) PCT Filed: Mar. 26, 2018

(86) PCT No.: PCT/US2018/024363
§ 371 (c)(1),
(2) Date: Sep. 16, 2019

(87) PCT Pub. No.: WO2018/183201
PCT Pub. Date: Oct. 4, 2018

(65) Prior Publication Data

US 2020/0090919 A1 Mar. 19, 2020

Related U.S. Application Data

(60) Provisional application No. 62/477,179, filed on Mar. 27, 2017.

(51) Int. Cl.
*H01J 49/40* (2006.01)
*H01J 49/00* (2006.01)

(52) U.S. Cl.
CPC ..... *H01J 49/406* (2013.01); *H01J 49/0031* (2013.01)

(58) Field of Classification Search
None
See application file for complete search history.

(56) References Cited

U.S. PATENT DOCUMENTS 5,712,479 A 1/1998 Reilly et al.
7,385,187 B2 * 6/2008 Verentchikov ..... H01J 49/406 250/281

(Continued)

FOREIGN PATENT DOCUMENTS

JP 2003-346704 A 12/2003

OTHER PUBLICATIONS

International Search Report dated Jul. 5, 2018, relating to International Application No. PCT/US2018/024363.

*Primary Examiner* — Andrew Smyth
(74) *Attorney, Agent, or Firm* — Honigman LLP

(57) ABSTRACT

A multi-reflecting time-of-flight mass spectrometer (MR-TOF MS) includes an ion source, an orthogonal accelerator, and an ion mirror assembly. The ion source is capable of generating a beam of ions, and is arranged to accelerate the ions in a first direction along a first axis. The orthogonal accelerator is arranged to accelerate the ions in a second direction along a second axis. The second direction is orthogonal to the first direction. The ion mirror assembly includes a plurality of gridless planar mirrors and a plurality of electrodes. The plurality of electrodes are arranged to provide time-focusing of ions along a third axis substantially independent of ion energy and ion position.

23 Claims, 5 Drawing Sheets

(56) References Cited

U.S. PATENT DOCUMENTS

| | | | | |
|---|---|---|---|---|
| 10,593,533 | B2 * | 3/2020 | Hoyes | H01J 49/0004 |
| 10,629,425 | B2 * | 4/2020 | Hoyes | H01J 49/107 |
| 10,741,376 | B2 * | 8/2020 | Hoyes | H01J 49/061 |
| 2006/0214100 | A1 * | 9/2006 | Verentchikov | H01J 49/406 250/287 |
| 2007/0029473 | A1 * | 2/2007 | Verentchikov | H01J 49/406 250/281 |
| 2007/0176090 | A1 * | 8/2007 | Verentchikov | H01J 49/401 250/287 |
| 2010/0006752 | A1 * | 1/2010 | Panayi | H01J 49/405 250/281 |
| 2013/0056627 | A1 * | 3/2013 | Verenchikov | H01J 49/06 250/282 |
| 2014/0312221 | A1 * | 10/2014 | Verenchikov | H01J 49/282 250/282 |
| 2016/0035558 | A1 * | 2/2016 | Verenchikov | H01J 49/067 250/287 |
| 2016/0240363 | A1 | 8/2016 | Verenchikov | |
| 2018/0144921 | A1 * | 5/2018 | Hoyes | H01J 49/406 |
| 2018/0330936 | A1 * | 11/2018 | Hoyes | H01J 49/10 |
| 2018/0358219 | A1 * | 12/2018 | Hoyes | H01J 49/068 |

* cited by examiner

| E | Diam | full angle | Rbase | R(50%) |
|---|---|---|---|---|
| V/mm | mm | deg | x1000 | x1000 |
| 200 | 4 | 3 | 6 | 16 |
| 200 | 3.5 | 2.6 | 7 | 24 |
| 200 | 3 | 2.25 | 8 | 28 |
| 200 | 2.5 | 2 | 10 | 32 |
| 200 | 2 | 1.5 | 13 | 38 |

| E | Diam | full angle | Rbase | R(50%) |
|---|---|---|---|---|
| V/mm | mm | deg | x1000 | x1000 |
| 300 | 4 | 3 | 5.5 | 17 |
| 300 | 3.5 | 2.6 | 7 | 20 |
| 300 | 3 | 2.25 | 9.5 | 29 |
| 300 | 2.5 | 2 | 12 | 32 |
| 300 | 2 | 1.5 | 17 | 52 |

MULTI-REFLECTING TIME-OF-FLIGHT MASS SPECTROMETER

TECHNICAL FIELD

This disclosure relates to a time-of-flight mass spectrometer.

BACKGROUND

This section provides background information related to the present disclosure and is not necessarily prior art.

It may be beneficial in mass spectrometry, and in time-of-flight mass spectrometry (TOFMS) as well, to have a design, which provides high resolving power (resolution), high ion transmission (to achieve high sensitivity), and a reasonably sized instrument to be practical for use in certain applications (for example, in a scientific laboratory, on a factory floor, in a vehicle, on a space craft, etc).

In TOFMS it may be important to keep relevant aberration coefficients at a low value, or at zero. Low aberration coefficients may be achieved by a special arrangement of the ion mirror electrodes geometry, position and electrical potentials applied to them and other elements of the ion optics.

The aberration coefficients may be derived from the motion equations while using aberration expansion. The order of aberrations defines their contribution in overall aberrations and thus resolving power of the TOFMS. It is also described as an order of focusing. For example, if a high-resolution TOF mass analyzer has second order time focusing in the Y-axis, it means that first and second order time aberration for the Y-axis are zero. On a more practical note, it means that ions starting from slightly different positions on the Y-axis will have the same TOF (barring other aberration contributions). As used herein, the Y-axis refers to the plane transverse to the ion path plane.

Achieving time focusing in the Y-axis means that ions may arrive at the detector simultaneously (or almost simultaneously) even if they have various Y-parameter values. For example, if ions start at different points along the Y-axis, because time focusing for Y is achieved in the TOFMS design, all ions starting their path simultaneously may arrive at the detector simultaneously or almost simultaneously. That "almost" factor is defined by the value of the corresponding aberration coefficient—less this value, less the difference in arrival time of ions. If the time aberration coefficient is zero then arrival time of the ions will be the same despite different initial conditions at corresponding parameter.

SUMMARY

This section provides a general summary of the disclosure, and is not a comprehensive disclosure of its full scope or all of its features.

One aspect of the disclosure provides a multi-reflecting time-of-flight mass spectrometer (MR-TOF MS). The MR-TOF MS includes an ion source, an orthogonal accelerator, and an ion mirror assembly. The ion source is capable of generating a beam of ions, and is arranged to accelerate the ions in a first direction along a first axis. The orthogonal accelerator is arranged to accelerate the ions in a second direction along a second axis. The second direction is orthogonal to the first direction. The ion mirror assembly includes a plurality of gridless planar mirrors and a plurality of electrodes. The plurality of electrodes are arranged to provide time-focusing of ions along a third axis substantially independent of ion energy and ion position.

Implementations of the disclosure may include one or more of the following optional features. In some implementations, the ion source is configured to generate a continuous beam of ions.

In some implementations, at least one of the plurality of electrodes is configured to provide spatial focusing of the ions in the first axis.

In some implementations, at least one of the plurality of electrodes is configured to provide spatial focusing of the ions in the third axis.

In some implementations, the mirror assembly further comprises an edge deflector configured to reverse the direction of the ions along the first axis.

In some implementations, the ion source is selected from the group consisting of ESI, APPI, APCI, ICP, EI, CI, SIMS, and MALDI.

In some implementations, the ion mirror assembly forms a two-dimensional electrostatic field. The ion mirrors may include one or more mirror electrodes having parameters that are selectively adjustable and adjusted to provide less than 0.001% variations of flight time within at least a 10% energy spread for a pair of ion reflections by the ion mirrors. The ion mirror assembly may form a two-dimensional electrostatic field of a planar symmetry or a two-dimensional electrostatic field of a hollow cylindrical symmetry.

In some implementations, the MR-TOF MS does not contain any lenses for focusing the ions in the Z-direction.

In some implementations, the ion source, the orthogonal accelerator, and the ion mirror assembly are arranged such that the ion mirror assembly reflects the ions between 6 and 12 times prior to contacting the detector. The ion mirror assembly may reflect the ions 10 times prior to contacting the detector.

In some implementations, the ion mirror assembly allows for ion focusing spatially in the Y-direction and also allows for time focusing in the Y-direction. The MR-TOF MS may also allow for increased width of the ion packet in the Z-direction, which may allow for increasing the duty cycle.

Another aspect of the disclosure provides a method of mass spectrometric analysis. The method may include forming a beam of ions in an ion source and accelerating the ions in a first direction along a first axis. The method may also include accelerating the ions with an orthogonal accelerator in a second direction along a second axis. The second direction may be orthogonal to the first direction. The method may further include reflecting the ions at least once with an ion mirror assembly comprising a plurality of gridless planar mirrors. The ion mirror assembly may include a plurality of electrodes arranged to provide time-focusing of ions along a third axis substantially independent of ion energy and ion position. The method may also include detecting the arrival time of the ions with a detector.

This aspect may include one or more of the following optional features.

In some implementations, the beam of ions is continuous.

In some implementations, the method includes spatially focusing the ions in the first axis with at least one of the plurality of electrodes.

In some implementations, the method includes spatially focusing the ions in the third axis with at least one of the plurality of electrodes.

In some implementations, the method includes reflecting the ions with an edge deflector to reverse the direction of the ions along the first axis.

In some implementations, the ion source is selected from the group consisting of ESI, APPI, APCI, ICP, EI, CI, SIMS, and MALDI.

In some implementations, the ion mirror assembly forms a two-dimensional electrostatic field. The ion mirrors may include one or more mirror electrodes having parameters that are selectively adjustable and adjusted to provide less than 0.001% variations of flight time within at least a 10% energy spread for a pair of ion reflections by the ion mirrors. The ion mirror assembly may form a two-dimensional electrostatic field of a planar symmetry or a two-dimensional electrostatic field of a hollow cylindrical symmetry.

Yet another aspect of the present disclosure provides a multi-reflecting time-of-flight mass spectrometer (MR-TOF MS) comprising an ion source, an orthogonal accelerator, and an ion mirror assembly. The ion source is capable of generating a beam of ions and arranged to accelerate the ions in a first direction along a first axis. The orthogonal accelerator is arranged to accelerate the ions in a second direction along a second axis. The second direction is orthogonal to the first direction. The ion mirror assembly includes a plurality of gridless planar mirrors and a plurality of electrodes. The plurality of electrodes are arranged to provide time-focusing of ions in a third axis substantially independent of ion energy and ion position.

In another aspect, the present disclosure provides a method of mass spectrometric analysis is described, comprising forming a beam of ions in an ion source; accelerating the ions in a first direction along a first axis; accelerating the ions with an orthogonal accelerator in a second direction along a second axis, wherein the second direction is orthogonal to the first direction; reflecting the ions at least once with an ion mirror assembly comprising a plurality of gridless planar mirrors, wherein the ion mirror assembly comprises a plurality of electrodes arranged to provide time-focusing of ions in a third axis substantially independent of ion energy and ion position; and detecting the arrival time of the ions with a detector.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Figure 1:
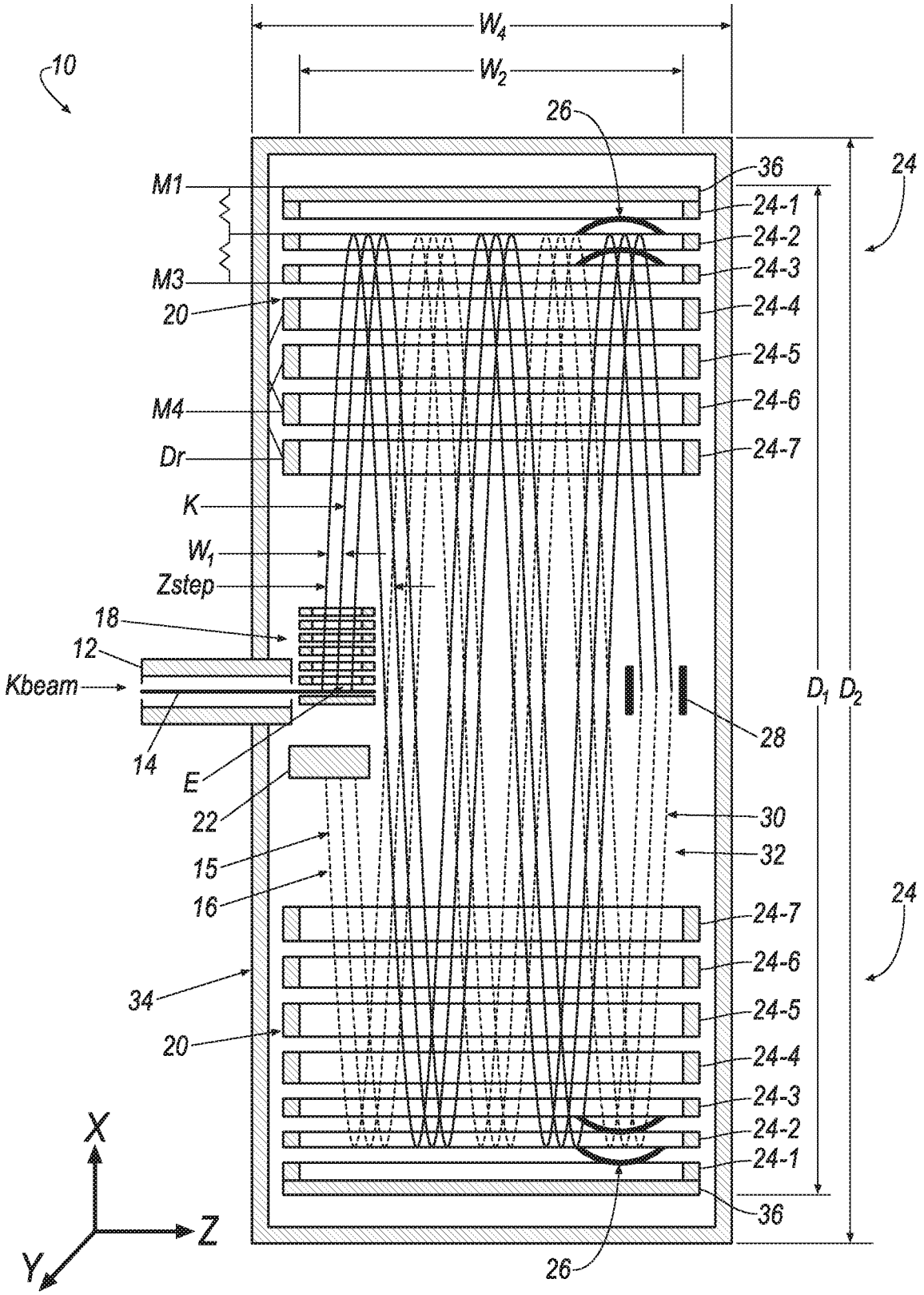
FIG. 1 is a cross-sectional view of a multi-reflecting time-of-flight mass spectrometer according to the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Figure 2:
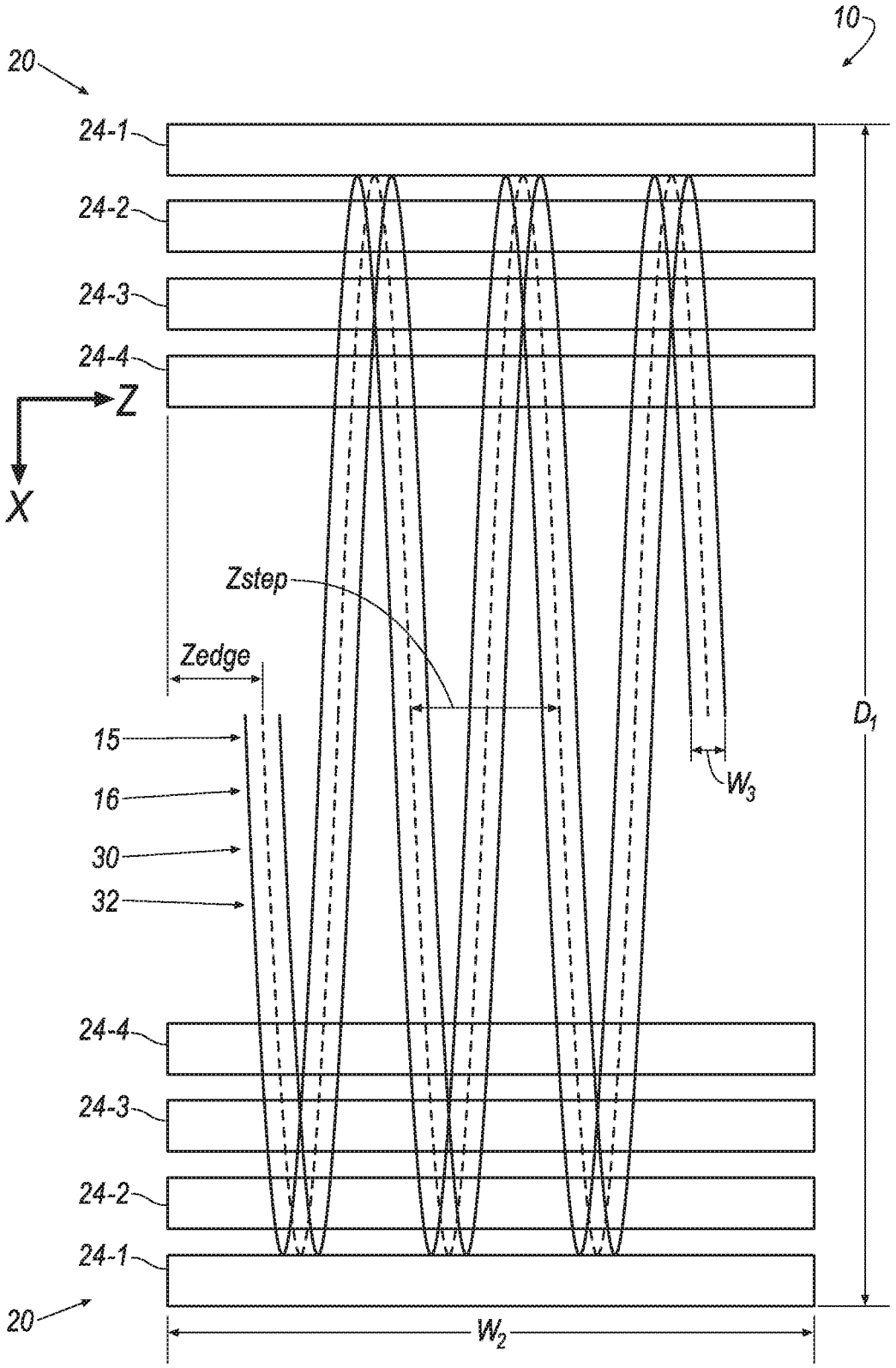
FIG. 2 is a schematic view of a multi-reflecting time-of-flight mass spectrometer according to the present disclosure.

With reference to FIGS. 1 and 2, one aspect of the present disclosure includes a multi-reflecting time-of-flight mass spectrometer (MR-TOF MS) 10. The MR-TOF MS 10 may include an ion source 12, an orthogonal accelerator (OA) 18, a pair of ion mirror assemblies 20, and a detector 22.

The ion source 12 may be arranged to accelerate a beam of ions 14 in a first direction and along a first axis, hereinafter referred to as the Z-axis. During operation, the beam of ions 14 may be directed into the orthogonal accelerator 18. As used herein, the beam of ions generated by the ion source 12 and directed into the orthogonal accelerator 18 may generally be referred to as the beam of ions 14, whereas, after being accelerated by the orthogonal accelerator 18, the beam of ions may generally be referred to as a beam of ions 15.

Any suitable means for generating ions 14 may be used as the ion source 12. For example, the ion source 12 may produce a continuous or quasi-continuous beam of ions 14. The ion source 12 may also be electrospray ionization (ESI), atmospheric pressure chemical ionization (APCI), atmospheric pressure photo-ionization (APPI), electron impact (EI), chemical ionization (CI), inductively coupled plasma ionization (ICP), secondary ion mass spectrometry (SIMS), and matrix-assisted laser desorption/ionization (MALDI).

The orthogonal accelerator 18 for accelerating the ions 14 along the X-Axis may be any suitable ion accelerator known in the art. For example, the orthogonal accelerator 18 may use electromagnetic fields to increase the speed of the ions 14. For example, the orthogonal accelerator 18 described in Guilhaus et al., U.S. Pat. No. 5,117,107, which is incorporated herein by reference in its entirety, may be used to accelerate the ions 14 along the X-Axis.

The orthogonal accelerator 18 may be arranged to accelerate the ions 14 in a second direction, which is orthogonal to the first direction, and along a second axis, hereinafter referred to as the X-axis. For example, the orthogonal accelerator 18 may accelerate the ions 14 with an energy E. In some implementations, the energy E is substantially equal to 500 volts per millimeter.

The orthogonal accelerator 18 may be aligned with a mass analyzer 34. Such a scheme is known as a normal orthogonal scheme. In using a normal orthogonal scheme, there may be no need for steering an ion packet 32, which may eliminate multiple aberrations relating to steering ion beam 15. The ion packets 32 may become narrow in the Y-direction, which may significantly reduce cross term aberrations. The normal orthogonal scheme may mean that lenses for focusing ion packets 32 in the Z-direction allow for longer ion packets 32 in the Z-direction. The normal orthogonal scheme may allow for reaching high resolution at much shorter ion paths 16, which may allow for more frequent pulsing. The combination of higher pulsing frequency and longer ion packets 32 may allow for enhancing sensitivity and dynamic range.

The ion mirror assembly 20 may include a plurality of ion mirrors 26, a plurality of mirror electrodes 24, and an edge deflector 28. The mirror assembly 20 may be capable of time-focusing the ions 15 in the Y-direction. For example, the electrodes 24 may be arranged to provide time-focusing of the ions 15 along a third axis, hereinafter referred to as the Y-axis, substantially independent of ion energy and ion position. Electrodes for time-focusing ions in the Y-direction are known in the art, and are described in, for example, Verenchikov et al., U.S. Pat. No. 7,385,187, which is incorporated herein by reference in its entirety.

The ion mirror assembly 20 may then reflect the ions 15. For example, the plurality of ion mirror electrodes 24 may include two sets of seven ion mirror electrodes 24-1-24-7. For example, the ion mirror assembly 20 may be arranged such that the ions 15 are reflected and travel in an opposite direction along the X-axis. The ions 15 may then contact the detector 22, which measures the quantity, and a time-of-flight, of the ions 15. The ion mirror assembly 20 may include mirror caps 36. In some implementations, one of the ion mirrors 26 includes the mirror cap 36. For example, the mirror caps 36 may abut one of the ion mirror electrodes 24.

The ion mirror electrodes 24 may be symmetrical, gridless planar mirrors or symmetrical, hollow cylindrical mirrors. The ion mirrors 26 may be shaped so that the ion packets 32 are focused in the Z-direction. For example, the ion mirrors 26 may include a concave surface facing a concave surface of another ion mirror 26 or facing the edge deflector 28. One of the electrodes 24 of the ion mirror assembly 20, e.g., the last electrode 24, may be arranged to create spatial focusing of the ions 15 in the Z-direction.

High-order focusing mirror assemblies for decreasing time-of-flight aberrations may be incorporated into the mirror assembly 20. The high-order focusing ion mirror assembly may form a two-dimensional electrostatic field either of a planar symmetry or a hollow cylindrical symmetry, and the ion mirror assembly 20 may include one or more mirror electrodes 24 having parameters that are selectively adjustable and adjusted to provide less than 0.001% variations of flight time within at least a 10% energy spread for a pair of ion reflections by the ion mirror assembly 20. Such high-order focusing mirror assemblies are described in the art, for example in Verenchikov et al., U.S. Pat. No. 9,396,922, which is incorporated herein by reference.

The edge deflector 28 may reflect the ions 15 in the Z-direction. Where the mirror assembly 20 includes an edge deflector 28, the detector 22 may be on the same side of the mass analyzer 34 as the orthogonal accelerator 18, while the edge deflector 28 may be on an opposite side of the mass analyzer 34 from the orthogonal accelerator 18. The detector 22 may be also placed on the opposite side of the mass analyzer 34 from the orthogonal accelerator 18. In that case the edge deflector 28 may be omitted.

The MR-TOF MS 10 may be lens-less. For example, the MR-TOF MS 10 may not contain any lenses that focus the ions in the Z-direction. The absence of lenses may allow for significantly increasing the duty cycle by increasing a width $W_1$ of the ion packet 32 in the Z-direction. This may also increase a filling time of the orthogonal accelerator 18. An MR-TOF MS 10 with no lens array may cost less to build than a corresponding instrument that contains a lens array.

Referring now to FIG. 1, the MR-TOF MS 10 is shown. The path of ions 16 from the ion beam 15 is also shown in FIG. 1. In FIG. 1, the ion source 12, orthogonal accelerator 18, and ion mirror assembly 20 are arranged so that the ion mirror assembly 20 will reflect the ions 15 ten times before contacting the detector 22, however, the ions 15 may be reflected between six and twelve times before contacting the detector 22. The MR-TOF MS 10 of FIG. 1 includes the detector 22 located on the same side of the instrument as the orthogonal accelerator 18. The MR-TOF MS 10 shown in FIG. 1 includes the edge deflector 28, which reverses the direction of the ions 15 in the Z-direction to reflect the ions 15 back toward the detector 22. The MR-TOF MS 10 may include particular parameters for operating the MR-TOF MS 10, but the parameters may be varied to achieve different results.

Referring to FIG. 2, the MR-TOF MS 10 may define a distance Di between ion mirrors 24 of 600-650 mm. The window width $W_2$ of the ion mirrors 24 is 340 mm. FIG. 2 shows a distance of 20 mm for the width $W_3$ of an ion flowpath or pencil 30. The MR-TOF MS 10 shown in FIG. 2 may include particular parameters for operating the MR-TOF MS 10, but the parameters may be varied to achieve different results.

Figure 5:
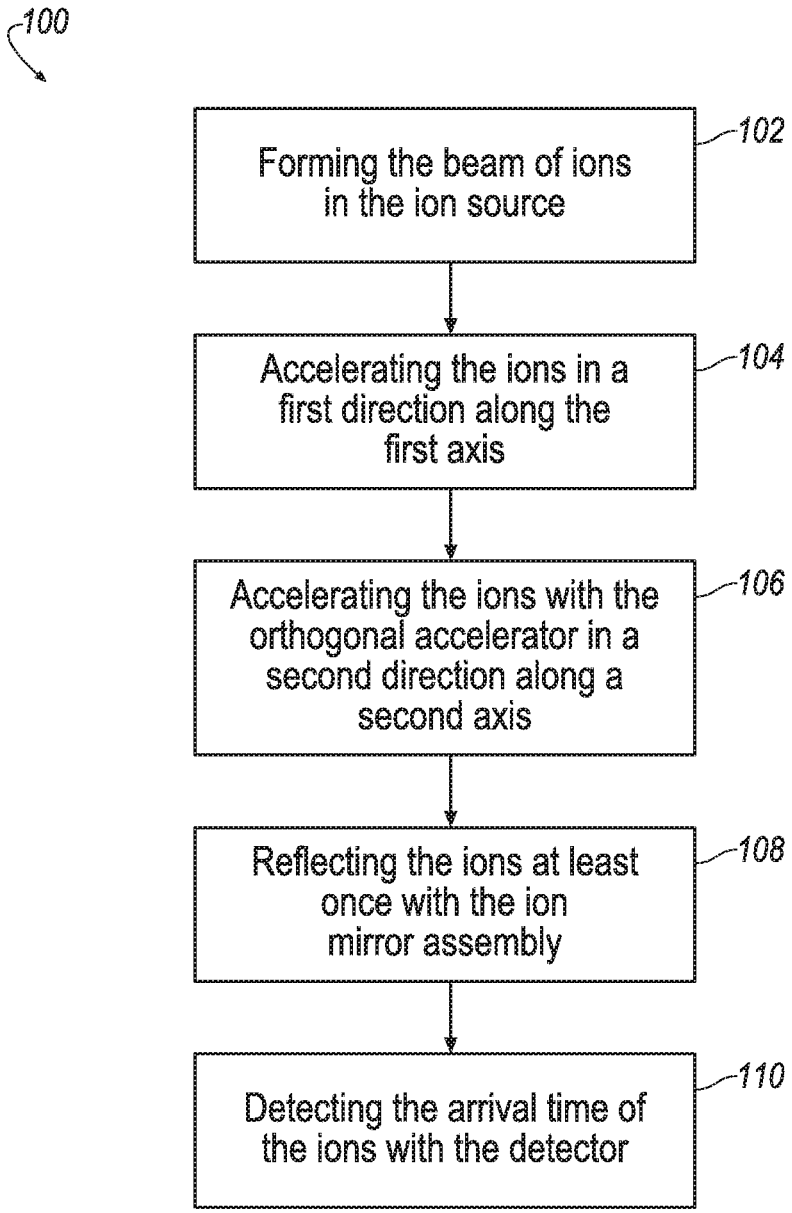
FIG. 5 is a flowchart illustrating a method of mass spectrometric analysis according to the present disclosure.

With reference to FIG. 5, a method 100 of mass spectrometric analysis is illustrated. At step 102, the method 100 may include forming a beam of ions 14 in the ion source 12. At step 104, the method may include accelerating the ions 14 in a first direction along the first axis. For example, at step 104, the method may include accelerating the ions 14 along the Z-axis. At step 106, the method may include accelerating the ions 14 with the orthogonal accelerator 18 in a second direction along a second axis. For example, at step 106, the method may include accelerating the ions 14 along the X-axis. The second direction may be orthogonal to the first direction. At step 108, the method may include reflecting the ions 15 at least once with the ion mirror assembly 20. At step 110, the method may include detecting the arrival time of the ions with the detector 22.

The method may include using a continuous or quasi-continuous beam of ions 14. The ion source 12 may also be selected from the group consisting of ESI, APPI, APCI, ICP, EI, CI, SIMS, and MALDI.

At step 112, the method may also include using at least one of the ion mirrors 26 to spatially focus the ions 15 in the Z-direction. At step 114, the method may include reflecting the ions 15 with the edge deflector 28 to reverse the direction of the ions 15 along the first axis. At step 116, the method may also include using high-order mirrors to form a two-dimensional electrostatic field either of a planar symmetry or a hollow cylindrical symmetry. The ion mirror assembly 20 may include one or more of the mirror electrodes 24 having parameters that are selectively adjustable and adjusted to provide less than 0.001% variations of flight time within at least a 10% energy spread for a pair of ion reflections by the ion mirrors 26.

A first example of the MR-TOF MS 10 is described by the parameters described in Table 1 below. The parameters described below may be varied to achieve different results. In this particular example, the edge deflector 28 was used.

TABLE 1

| Parameters of a first example MR-TOF MS 10. |
|---|
| Ion Mirrors: |
| Cap-cap Distance $D_1$ = 600 mm<br>Chamber Length $D_2$ = 700 mm<br>Mirror Y-window: 20-22 mm<br>T\|kkk = 0; Low T\|kkkk allow R = 120K<br>At dK/K = 6.5% and dY < 4.5 mm<br>Dual Mirror lens allows K = 9.2 keV at M4 = −15 kV<br>M1 = +3 kV, M3 = −1 kV |
| Mirror Z-width: |
| Mirror Zedge = 35 mm<br>5 reflections (one way) × 40 mm = 200 mm<br>Window Width $W_2$ = 270 mm<br>Chamber Width $W_4$ = 320 mm |
| Flight Time: |
| Leff: 600 mm/refl<br>Ltotal: 6 m<br>K = 9.2 keV; V(1000 amu) = 43 m/ms<br>T(1000 amu) = 140 us |
| Duty Cycle and Inclination: |
| Push: 2400 V; OA gap = 6 mm; E = 500 V/mm<br>Inclination: 67 mrad<br>Kbeam = 9200/(40/600)^2 = 41 eV<br>V(1000 amu) = 2.86 mm/us<br>Z packet: 20 mm; $T_{OA}$: 7 us; DC = 5%<br>Beam Z divergence = 1 mrad; dZ = 6 mm<br>100% transmission to detector (Zstep = 40 mm)<br>No periodic lens, use collimators in Z |

TABLE 1-continued

| Parameters of a first example MR-TOF MS 10. |
|---|
| Turn around Vs dK: |
| Beam: 1.2 mm; dK: 480 eV<br>Beam divergence: 1 deg = 17 mrad<br>dVx: 49 m/s; $T_{TA}$: 0.98 ns |
| Resolution: |
| Detector 0.5 ns (MagTOF), DAS: 4Gss, dT = 0.7 ns<br>$R_{TA}$: 71K; dT: 0.98 ns<br>$R_K$ > 120K; $d_{TA}$ < 0.58 ns (dY = 4 mm, dK/K = 6.5%)<br>FWHM: 1.35 ns; R = 52K<br>BUT: dX time front: 23 mm*67/1000 = 1.5 mm;<br>Packet = 1.36 ns (acquired w/o centroids) |

In a second example, the MS-TOF MS 10 may be based on planar mirror electrodes 24 with the window width $W_2$ of 340 mm and horizontal position of the orthogonal accelerator (OA) 18 (i.e. Z-direction of continuous ion beam). The parameters of the MS-TOF 10 in this example are according to the specifications shown in FIG. 2. The height of the mirror window in the Y-axis is 24 mm. Both the detector 22 and the primary focus positions of the OA 18 were assumed to be located at a median plane of the mass analyzer 34 (in the middle between two mirrors). The 3-turn (6-reflection) scheme as shown in FIG. 2 can be realized for the 20 mm width $W_3$ of the ion pencil 30 and the Z-offset of an outer edge of the ion pencil 30 from the mirror window inner boundary of 25 mm, which guarantees the TOF distortion due to the mirror fringing fields to be <0.3 ns. The Zedge=35 mm from the center of the ion pencil 30 to the mirror window inner boundary, and the Zstep=90 mm. With the ion kinetic energy of K=8000 eV and the distance Di between the mirror caps 36 of 600-650 mm the kinetic energy of the continuous ion beam 14 is 30-40 eV. The goal of the design is obtaining the mass resolving power of the analyzer R>20,000 with a possibly maximal diameter of the continuous ion beam 15.

To choose a proper extracting field strength of the OA 18, time peak shapes of ions of the mass m=1,000 a.m.u. were calculated at the detector in the 3-turn analyzer with the ion mirror optimized with 5th-order TOF focusing in energy under the assumption of zero-length gaps between the adjacent electrodes in two cases: E=200 V/mm (see FIG. 3) and E=300 V/mm (see FIG. 4) and with five different continuous beam parameters in the OA 18: d=2 mm, a=±0.75°; d=2.5 mm, a=±1°; d=3 mm, a=±1.125°; d=3.5 mm, a=±1.3°; d=4 mm, a=±1.5°. In this test simulation, the ion mirror 24 was optimized "by itself", without taking into account the aberrations caused by the OA 18.

Figure 3:
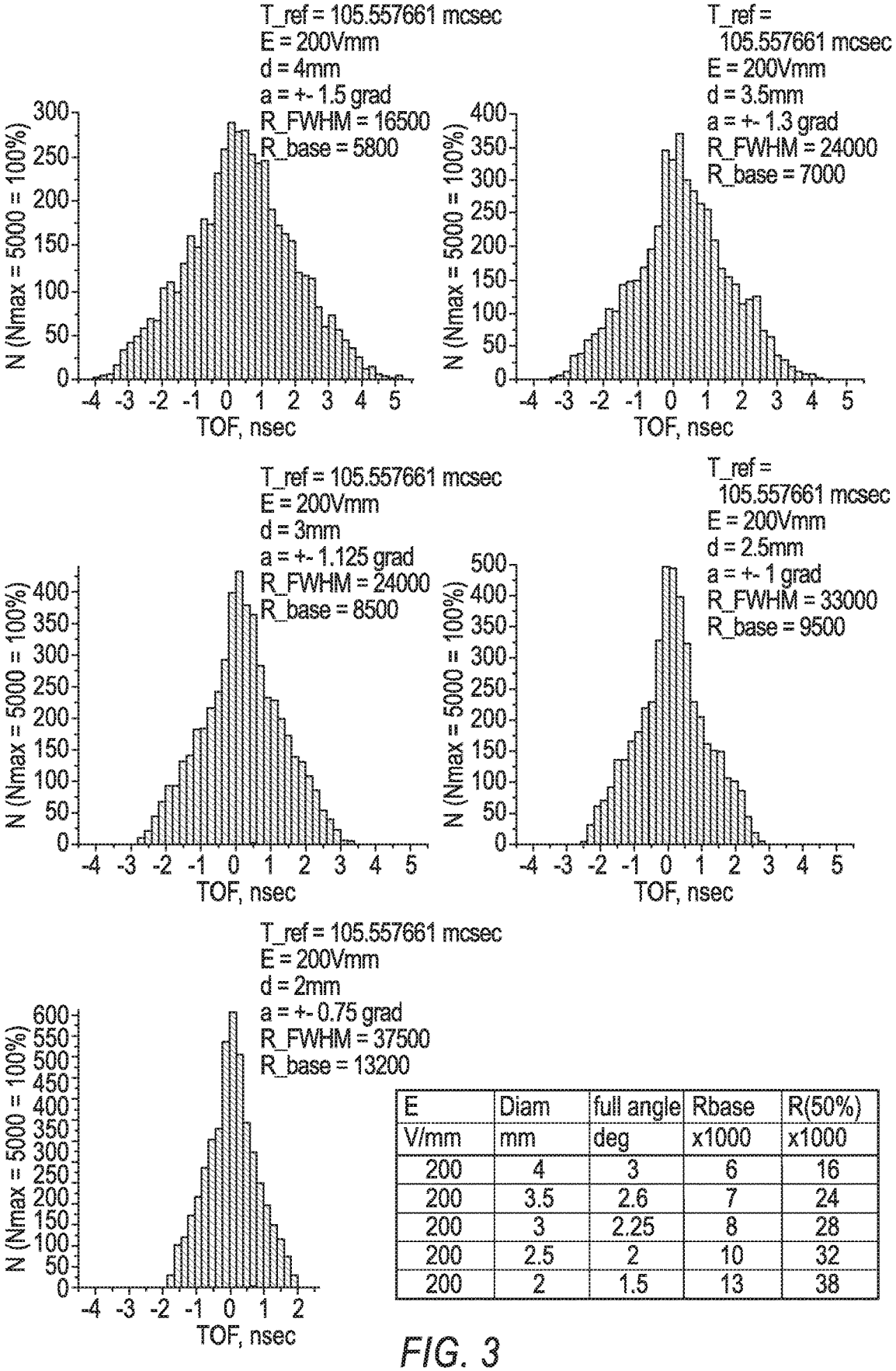
FIG. 3 shows peak shapes at a detector for a multi-reflecting time-of-flight mass spectrometer with E=200 V/mm at various beam diameters according to the present disclosure.
Figure 4:
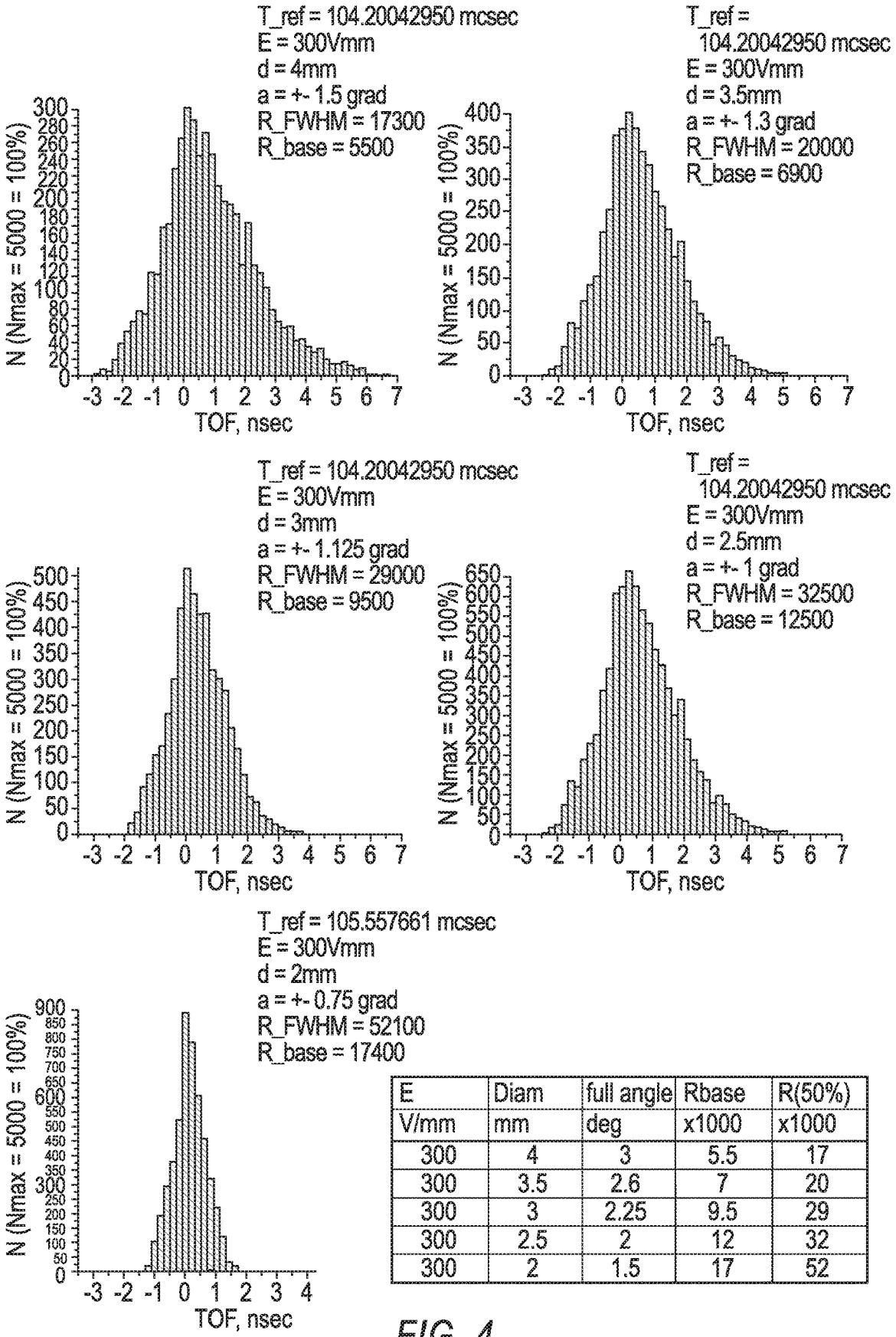
FIG. 4 shows peak shapes at a detector for a MR-TOF MS with E=300 V/mm at various beam diameters according to the present disclosure.

The corresponding peak shapes are presented in FIG. 3 (for E=200 V/mm) and FIG. 4 (for E=300 V/mm). As is seen from FIGS. 3-4, the mass resolving power at full width at half maximum (FWHM) and at peak base remain similar for both values of the extracting field strengths in cases of large continuous beam diameters. This is caused by compensating a smaller initial time width of the signal at the primary focus of the OA 18 at E=300 V/mm by aberrations caused by a larger energy spread. However, with decreasing the diameter of the continuous ion beam 15, in cases where the contribution of the aberrations decrease, the larger value of the extracting field strength becomes preferable.

The foregoing disclosure has been described in some detail by way of illustration and example, for purposes of clarity and understanding, and with reference to various specific examples and techniques. However, many variations and modifications can be made within the scope of the appended claims. Therefore, it is to be understood that the above description is intended to be illustrative and not restrictive. The scope of the following appended claims should consider the full scope of equivalents to which such claims are entitled.

What is claimed is:

1. A multi-reflecting time-of-flight mass spectrometer (MR-TOF MS), comprising:

an ion source, capable of generating a beam of ions, arranged to accelerate the ions in a first direction along a first axis;

an orthogonal accelerator arranged to accelerate the ions in a second direction along a second axis, wherein the second direction is orthogonal to the first direction; and an ion mirror assembly comprising a plurality of gridless planar mirror electrodes, a plurality of mirrors, and an edge deflector configured to reverse a direction of travel of the ions along the first axis, the plurality of gridless planar mirror electrodes arranged to provide time-focusing of ions along a third axis substantially independent of ion energy and ion position, the plurality of mirrors including a first mirror having a first concave surface and a second mirror having a second concave surface, the first concave surface facing the second concave surface, and the edge deflector being disposed between the first concave surface and the second concave surface.

2. The MR-TOF MS of claim 1, wherein the ion source is configured to generate a continuous beam of ions.

3. The MR-TOF MS of claim 1, wherein at least one of the plurality of gridless planar mirror electrodes is configured to provide spatial focusing of the ions in the first axis.

4. The MR-TOF MS of claim 1, wherein at least one of the plurality of gridless planar mirror electrodes is configured to provide spatial focusing of the ions in the third axis.

5. The MR-TOF MS of claim 1, wherein the ion source is selected from the group consisting of ESI, APPI, APCI, ICP, EI, CI, SIMS, and MALDI.

6. The MR-TOF MS of claim 1, wherein the ion mirror assembly forms a two-dimensional electrostatic field, and wherein the plurality of mirrors include one or more mirror electrodes having parameters that are selectively adjustable and adjusted to provide less than 0.001% variations of flight time within at least a 10% energy spread for a pair of ion reflections by the plurality of mirrors.

7. The MR-TOF MS of claim 6, wherein the ion mirror assembly forms a two-dimensional electrostatic field of a planar symmetry.

8. The MR-TOF MS of claim 6, wherein the ion mirror assembly forms a two-dimensional electrostatic field of a hollow cylindrical symmetry.

9. The MR-TOF MS of claim 1, wherein the MR-TOF MS does not contain any lenses for focusing the ions in the first direction.

10. The MR-TOF MS of claim 1, wherein the ion source, the orthogonal accelerator, and the ion mirror assembly are arranged such that the ion mirror assembly reflects the ions between 6 and 12 times prior to contacting a detector.

11. The MR-TOF MS of claim 10, wherein the ion mirror assembly reflects the ions 10 times prior to contacting the detector.

12. A method of mass spectrometric analysis comprising:

forming a beam of ions in an ion source;

accelerating the ions in a first direction along a first axis;

accelerating the ions with an orthogonal accelerator in a second direction along a second axis, wherein the second direction is orthogonal to the first direction;

reflecting the ions at least once with an ion mirror assembly comprising a plurality of gridless planar mirror electrodes and a plurality of mirrors, the plurality of gridless planar mirror electrodes arranged to provide time-focusing of ions along a third axis substantially independent of ion energy and ion position, the plurality of mirrors including a first mirror having a first concave surface and a second mirror having a second concave surface, the first concave surface facing the second concave surface;

reflecting the ions with an edge deflector to reverse a direction of travel of the ions along the first axis, the edge deflector being disposed between the first concave surface and the second concave surface; and detecting an arrival time of the ions with a detector.

13. The method of claim 12, wherein the beam of ions is continuous.

14. The method of claim 12, further comprising spatially focusing the ions in the first axis with at least one of the plurality of gridless planar mirror electrodes.

15. The method of claim 12, further comprising spatially focusing the ions in the third axis with at least one of the plurality of gridless planar mirror electrodes.

16. The method of claim 12, wherein the ion source is selected from the group consisting of ESI, APPI, APCI, ICP, EI, CI, SIMS, and MALDI.

17. The method of claim 12, wherein the ion mirror assembly forms a two-dimensional electrostatic field, and wherein the plurality of ion mirrors include one or more mirror electrodes having parameters that are selectively adjustable and adjusted to provide less than 0.001% variations of flight time within at least a 10% energy spread for a pair of ion reflections by the plurality of ion mirrors.

18. The method of claim 17, wherein the ion mirror assembly forms a two-dimensional electrostatic field of a planar symmetry.

19. The method of claim 17, wherein the ion mirror assembly forms a two-dimensional electrostatic field of a hollow cylindrical symmetry.

20. The MR-TOF MS of claim 1, wherein the first direction extends orthogonal to the first concave surface.

21. The method of claim 12, wherein the first direction extends orthogonal to the first concave surface.

22. The MR-TOF MS of claim 1, further including a first end and a second end spaced apart from the first end in a direction parallel to the second axis, the first mirror being disposed proximate the first end and the second mirror being disposed proximate the second end, and the edge deflector being disposed approximately midway between the first mirror and the second mirror.

23. The method of claim 12, wherein the mass spectrometric analysis is conducted by a multi-reflecting time-of-flight mass spectrometer (MR-TOF MS), the MR-TOF MS including a first end and a second end spaced apart from the first end in a direction parallel to the second axis, the first mirror being disposed proximate the first end and the second mirror being disposed proximate the second end, and the edge deflector being disposed approximately midway between the first mirror and the second mirror.

* * * * *